US005953778A

United States Patent [19]

Hiatt

[11] Patent Number: 5,953,778

[45] Date of Patent: Sep. 21, 1999

[54] ARTICULATED MATTRESS

[75] Inventor: Sidney A. Hiatt, Carthage, Mo.

[73] Assignee: L&P Property Management Company, South Gate, Calif.

[21] Appl. No.: 09/020,536

[22] Filed: Feb. 9, 1998

[51] Int. Cl.[6] ..... A47C 27/05

[52] U.S. Cl. ..... 5/716; 5/12.1; 5/722

[58] Field of Search ..... 5/716, 717, 718, 5/719, 720, 722, 727, 731, 12.1, 249, 250

[56] References Cited

U.S. PATENT DOCUMENTS

| | | | |
|---|---|---|---|
| 3,149,920 | 9/1964 | Maddux, Jr. et al. . | |
| 3,166,768 | 1/1965 | Cunningham . | |
| 4,642,823 | 2/1987 | Wiggins | 5/37.1 |
| 4,768,253 | 9/1988 | Boyd et al. | 5/722 X |
| 5,214,809 | 6/1993 | Stuart . | |
| 5,657,500 | 8/1997 | Messina | 5/722 |

FOREIGN PATENT DOCUMENTS 2827821 1/1980 Germany .

*Primary Examiner*—Michael F. Trettel
*Attorney, Agent, or Firm*—Wood, Herron & Evans, L.L.P.

[57] ABSTRACT

An articulated mattress comprising an articulated spring core, a mattress pad and an upholstered fabric covering encasing the articulated spring core and the mattress pad. The articulated spring core comprises at least two sections of spring core hingedly connected to each other with a foam hinge. The foam hinge may extend longitudinally or transversely. A plurality of fasteners secure the foam hinge to the end turns of the coil springs proximate the foam hinge.

30 Claims, 3 Drawing Sheets

ARTICULATED MATTRESS

FIELD OF THE INVENTION

This invention relates to articulated mattresses adapted to be used on adjustable beds or futons or any other bedding mechanism in which the mattress must be bent or folded.

BACKGROUND OF THE INVENTION

Adjustable beds are commonly used in hospitals as well as homes, generally for persons who must spend a great deal of time in the bed. Such beds often have multiple sections that may be adjusted in angular relation to one another so as to maximize the comfort of the user. A conventional mattress does not function properly when used in conjunction with one of these adjustable beds because the mattress is not intended to bend. The generally rectangular upper and lower border wires of a conventional mattress are rigid and not intended to be bent. Therefore, a conventional mattress is not suited to be used in conjunction with an articulated bed.

Mattresses have been designed and constructed which have multiple sections hingedly connected to each other in order to be used with adjustable beds. Such mattresses allow the contour of the mattress to fit the position in which the user places the adjustable bed. One such mattress is disclosed in U.S. Pat. No. 3,419,920. However, the different portions of this mattress are not made up of aligned coil springs but rather are made of polyurethane foam. The mattress disclosed in this patent has multiple hinges allowing one section of the mattress to move independently of the other sections.

Another patent which discloses an articulated mattress to be used in conjunction with an adjustable hospital bed is U.S. Pat. No. 5,214,809. This patent discloses an articulated innerspring mattress comprising four rigid spring core sections, each section being placed within a pocket of fabric. The pockets of fabric are hingedly connected to each other with a transversely extending hinge portion made from the fabric. The hinges enable the mattress to bend along transversely extending joints and the sections of spring core to be angularly inclined relative to each other. Above and below the transversely extending hinge are foam bars glued to the fabric hinge. The foam acts as a filler material and prevents the bunching of the fabric surrounding the rigid spring core sections. The four pockets are covered with a mattress pad and enclosed in a cover so as to complete the articulated mattress. The difficulty with this type of mattress construction is that the individual spring core sections must be pocketed increasing the cost of manufacturing the spring assembly and the amount of material necessary to construct the mattress. In addition, two pieces of resilient foam must be placed in each hinge and the foam adhesively secured to the fabric of the pockets and hinge. This increases the time and expense required to manufacture the mattress.

Another patent which discloses sections of a mattress which are bendable or foldable relative to one another is German Patent No. 2827821. This patent discloses a mattress having two sections of spring core connected to each other at a bendable joint. Layers of upholstery cover the top and bottom surfaces of the mattress. The end turns of the coil springs are embedded in layers of foam or adhesive which secures these coil springs to the upholstery layers. The upholstery is what actually connects the different sections of spring core to each other. Difficulties with this type of construction are that 1) foam or adhesive must be injected through the upholstery with hollow needles in order to secure the coil springs in place and 2) the end turns of the coil springs adjacent the hinge must be embedded in the adhesive or foam. This increases the time and costs of manufacturing the mattress. In addition, should a great deal of stress be placed on one coil spring section relative to the other, the end turns embedded in the foam or adhesive may rip or tear away from the foam or adhesive destroying the relationship between the sections of spring core.

Therefore, it has been one objective of the present invention to provide an articulated mattress in which multiple sections of spring core are hingedly connected to each other in a more secure manner than heretofore known articulated mattresses.

It further has been an objective of the present invention to provide an articulated mattress having foam hinges connecting multiple sections of spring core to each other.

It further has been an objective of the present invention to provide an articulated mattress in which the sections of spring core are fastened to a foam hinge with fasteners rather than end turns of coil springs being embedded in the foam.

SUMMARY OF THE INVENTION

The invention of this application which accomplishes these objectives comprises an articulated spring core, a mattress pad covering one surface of the spring core and an upholstered fabric covering encasing the articulated spring core and the mattress pad. The articulated mattress spring core has a longitudinal dimension defined by two end edges, a transverse dimension defined by two side edges and a depth dimension defined by top and bottom surfaces of the spring core, the longitudinal dimension being greater than the transverse dimension as in a conventional mattress.

The articulated mattress spring core comprises a first spring core section and a second spring core section hingedly connected to each other. Each spring core section comprises a plurality of coil springs arranged in transversely extending rows and longitudinally extending columns. The coil springs have an upper end turn, a lower end turn and a plurality of central convolutions therebetween. Each spring core section may have a upper border wire and a lower border wire secured to the end turns of the outermost coil springs of the spring core sections.

A transversely extending foam hinge connects the first and second spring core sections to each other. The foam hinge comprises a block of resilient foam extending the depth of the articulated mattress and an upper and lower piece of fabric adhesively secured to the upper and lower surfaces, respectively, of the block of resilient foam.

At least one transversely extending row of coil springs of each of the first and second spring core sections are secured to the foam hinge with fasteners such as hog rings. A portion of the upper and lower end turns of the coil springs proximate the foam hinge overlay the block of resilient foam. In addition, the upper and lower pieces of fabric extend outwardly and overlay the end turns of at least one transversely extending row of coil springs immediately proximate the foam hinge. Additional fasteners may secure the pieces of fabric to the end turns of the same coil springs. The end turns of the coil springs are connected to each other with helical lacing wires.

The foam hinge may also extend longitudinally such as, for example, in a mattress to be used with a futon. Such an articulated mattress comprises first and second spring core sections. Each section has a longitudinal dimension and a transverse dimension, the longitudinal dimension being greater than the transverse dimension. The coil springs of each section are arranged in longitudinally extending columns and transversely extending rows. Each spring core comprises a plurality of coil springs having end turns connected to each other with helical facing wires. Each spring core section may have an upper and lower border wire connecting the end turns of the outermost coil springs to each other.

The sections of spring core are connected to each other with a longitudinally extending foam hinge. The foam hinge is configured the same as the foam hinge described hereinabove. The end turns of the coil springs of at least one column of each spring core section, proximate the foam hinge have end turns overlaying the block of resilient foam. These overlying end turns are connected to the block of foam of the foam hinge with fasteners. Also, these end turns may be secured to the pieces of fabric of the foam hinge with additional fasteners.

Thus, the articulated mattress of the present invention utilizes a foam hinge to connect two adjacent spring core sections of an articulated spring core. Each section of the spring core may move independently of the other sections of the spring core, the foam block of the foam hinge compressing along one surface and expanding along the other surface when one spring core section is bent relative to the other.

These and other objects and advantages of the invention of this application will become more readily apparent from the following description of the drawings.

DETAILED DESCRIPTION OF THE DRAWINGS

Figure 1:
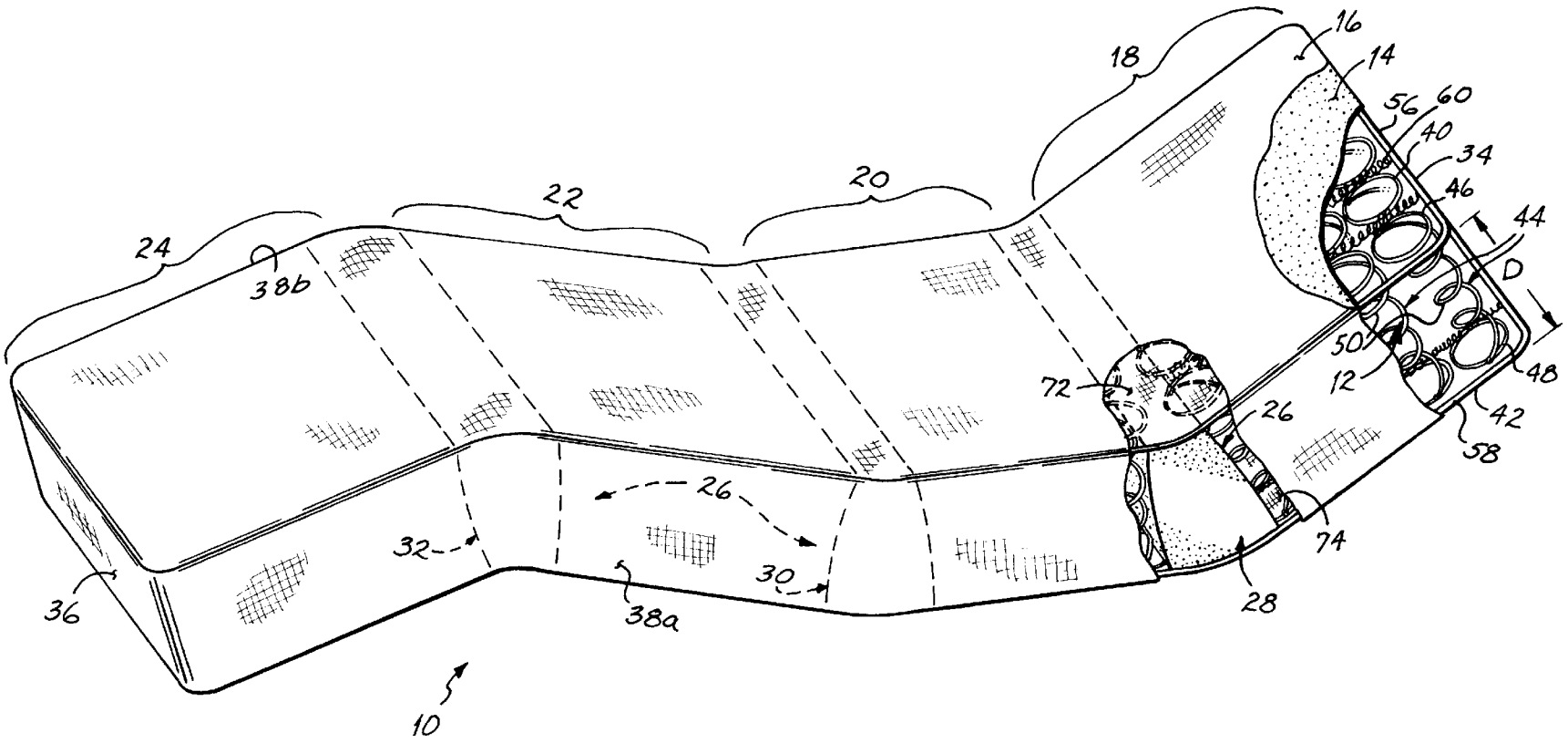
FIG. 1 is a perspective view of the articulated mattress of the present invention.

Referring to the drawings and particularly to FIG. 1, there is illustrated an articulated mattress 10. The articulated mattress 10 comprises an articulated spring core 12, a mattress pad 14 and an upholstered fabric covering 16 encasing the articulated spring core 12 and the mattress pad 14.

The mattress spring core 12 is divided into a head or first section 18, a second or chest section 20, a third or thigh section 22 and a fourth or foot section 24. As illustrated in FIG. 1, the different sections may be angled relative to one another so as to create an adjustable mattress to be used with adjustable beds, for example in hospitals. Each section can be independently adjusted without affecting the movement of the other sections due to a plurality of foam hinges 26. For purposes of illustration, FIG. 1 illustrates a first foam hinge 28 located between the first and second sections 18, 20 of the mattress spring core; a second foam hinge 30 located between the second and third sections 20, 22 of the spring core and a third foam hinge 32 located between the third and fourth sections 22, 24 of the spring core. Any number of sections of spring core may be connected with foam hinges without departing from the spirit of the invention of this application.

The articulated mattress spring core 12 has a first end edge 34 and a second end edge 36 at opposite ends of the mattress defining a longitudinal dimension or length of the mattress spring core. Similarly, the mattress spring core 12 has two opposed side edges 38*a*, 38*b* which define the width or transverse dimension of the articulated mattress spring core. The longitudinal dimension is greater than the transverse dimension in a conventional mattress spring core but the two may be equal as well without departing from the spirit of this invention. The mattress spring core 12 further has a uniform depth D extending between a top surface of the mattress spring core 40 and a bottom surface 42 of the mattress spring core. Because the upholstered fabric covering 16 is relatively thin, the length, width and depth of the articulated mattress 10 are essentially the same as that of the articulated spring core 12.

Figure 2:
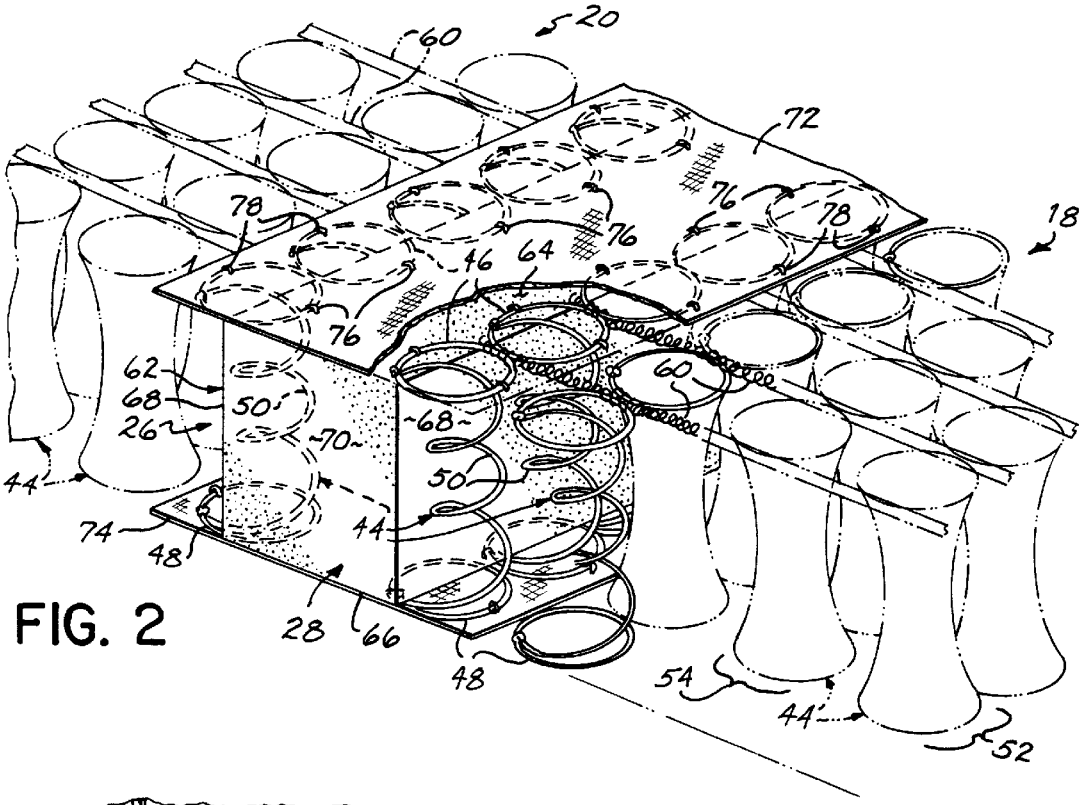
FIG. 2 is an enlarged perspective view of one of the foam hinges utilized in the articulated mattress of FIG. 1.

As illustrated in FIGS. 1 and 2, each spring core section comprises a plurality of coil springs 44, each coil spring 44 having an upper end turn 46, a lower end turn 48 and a plurality of central convolutions 50 therebetween. The coil springs 44 are arranged in longitudinally extending columns 52 and transversely extending rows 54. As best shown in FIG. 1, an upper border wire 56 may be secured to the upper end turns 46 of the outermost coil springs within a section and a lower border wire 58 may be secured to the lower end turns 48 of the outermost coil springs within a section.

The coil springs 44 may be individual coil springs such as unknotted coil springs or bonnell coil springs or the springs may be continuous coil springs such as those manufactured by the assignee of this application and identified as "Superlastic" or "Miracoil" springs. Any other configuration of spring may also be utilized in accordance with the present invention.

Figure 3:
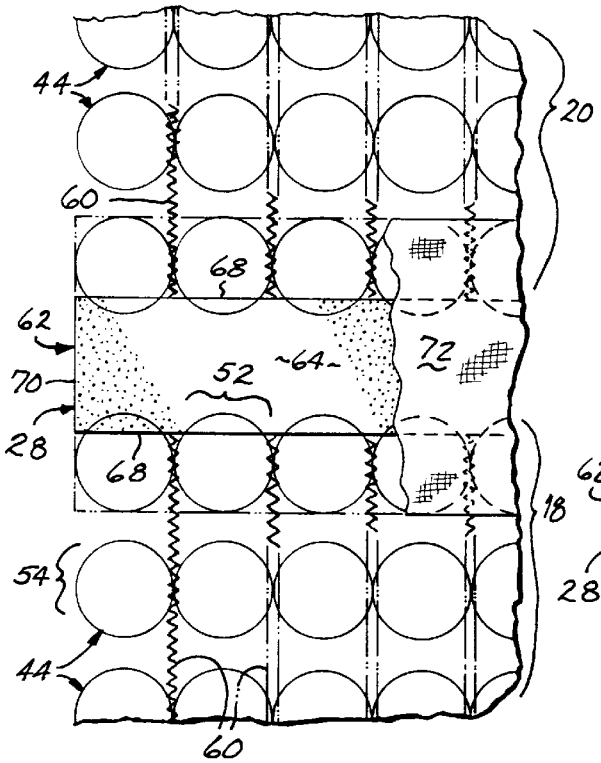
FIG. 3 is a top view of the foam hinge of FIG. 2.
Figure 4:
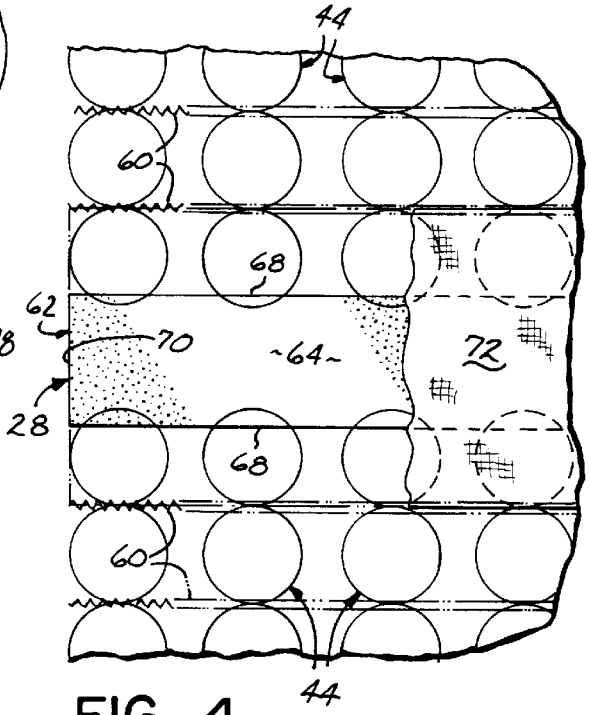
FIG. 4 is a top view similar to FIG. 3 illustrating an alternative embodiment of the spring core sections joined by the foam hinge.

Referring to FIG. 2, the coil springs 44 may be held together at their upper and lower end turns 46, 48 by a plurality of helical lacing wires 60. The helical lacing wires 60 may extend longitudinally (perpendicular the foam hinge) as illustrated in FIGS. 2 and 3 or may alternatively extend transversely (parallel the foam hinge 26) as illustrated in FIG. 4.

Referring to FIG. 2, the specifics of a foam hinge of the present invention will now be discussed. The foam hinge 26 extends between two adjacent sections of spring core and is connected to each section. For purposes of illustration, FIG. 2 illustrates the foam hinge 28 of FIG. 1 connecting first and second sections 18, 20 of the articulated mattress spring core 12 of FIG. 1. The foam hinge 28 comprises a block of resilient foam 62, preferably of urethane foam, having a rectangular upper surface 64, a rectangular lower surface 66, two rectangular side surfaces 68 located immediately adjacent the spring core sections 18, 20 and two rectangular end surfaces 70 such that the block of resilient foam 62 is a parallelepiped and has a square or rectangular cross section. The block of resilient foam 62 extends the full depth D of the articulated spring core such that the upper surface 64 of the block 62 is located in the top surface 40 of the spring core and the lower surface 66 of the block 62 is located in the bottom surface 42 of the spring core. As illustrated in FIG. 1, each hinge preferably extends for the full width of the articulated mattress spring core but need not necessarily extend so far.

The foam hinge 28 of the present invention further comprises an upper piece of fabric 72 and a lower piece of fabric 74 secured to the upper and lower surfaces 64, 66 of the foam block 62 respectively. Adhesive is most commonly used to secure the pieces of fabric 72, 74 to the foam block 62. However, any other alternative means may be used as well to secure the pieces of fabric to the foam block without departing from the spirit of the present invention. The width of the upper and lower pieces of fabric 72, 74 is greater than the width of the upper and lower surfaces 64, 66 of the block 62 of resilient foam so that the upper piece of fabric 72 overlays upper end turns 46 of at least one row 54 of coil springs 44 of each adjacent spring core section. At least one row 54 of coil springs 44 of each section is located immediately adjacent the foam hinge 26. Likewise, the lower piece of fabric 74 extends beneath the lower end turns 48 of at least one row 54 of coil springs 44 closest to the block of foam. The upper and lower pieces of fabric 72, 74 are preferably the same width but may be different widths.

A plurality of fasteners 76 secure the end turns of the row of coil springs closest to the block of resilient foam to the foam block. A second plurality of fasteners 78 secure the upper and lower end turns 46, 48 of the row of coil springs closest to the foam hinge 26 of each section adjacent the foam hinge to the upper and lower pieces of fabric 72, 74. For purposes of illustration, the fasteners are illustrated as being hog rings but may be any other conventional fasteners as well.

As illustrated in FIG. 1, when the first spring core section 18 is raised relative to the second spring core section 20, the upper surface 64 of the block 62 of foam compresses and the lower surface 66 of the block 62 of foam expands slightly allowing the first section of spring core 18 to move independently of the second section 20 of spring core.

Thus, as illustrated in FIG. 2, each independent section of spring core is connected to a foam hinge with independent fasteners located in the top and bottom surfaces of the spring core. Each block of foam 62 is more than just a filler filling space between the two spring core sections but instead acts as a connector connecting two adjacent sections of spring core to each other so that they cannot separate and can adjust angularly relative to one another.

Figure 5:
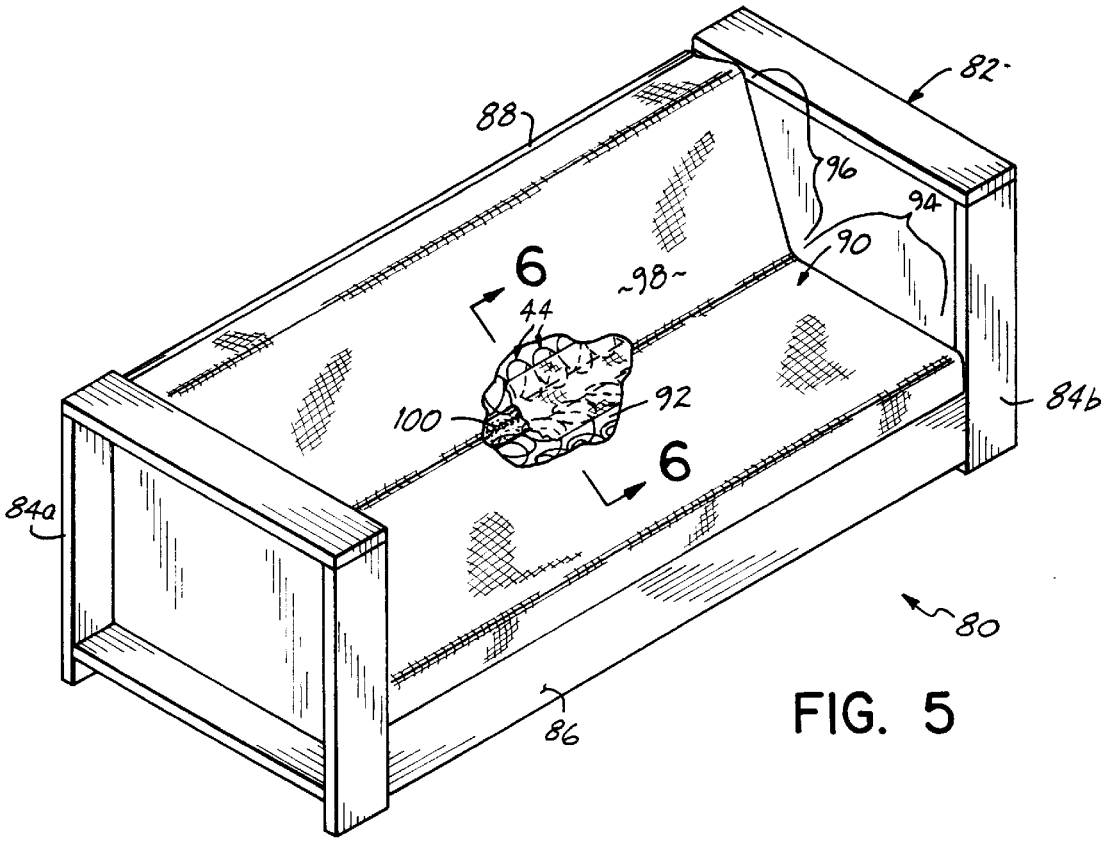
FIG. 5 is a perspective view of a futon utilizing an articulated mattress having a longitudinally extending foam hinge in accordance with the present invention.

In a second embodiment of the present invention, the foam hinge does not extend transversely as in an articulated mattress of FIG. 1, but rather extends longitudinally. One example in which this embodiment of the articulated mattress of the present invention is utilized is with a futon as illustrated in FIG. 5. FIG. 5 illustrates a futon 80 comprising a futon frame 82 having two opposed side pieces 84*a*, 84*b*, a seat support section 86 and a back support section 88. As in any conventional futon, the back support section 88 may be lowered from a raised portion as illustrated in FIG. 5 to a position in which it is coplanar with the seat support section 86.

An articulated futon mattress 90 may be placed on the futon frame and used in accordance therewith. The articulated futon mattress 90 comprises an articulated spring core 92 comprising a first spring core section 94 and a second spring core section 96 hingedly connected to each other in accordance with the present invention. A mattress cover 98 envelopes the articulated spring core 92.

Figure 7:
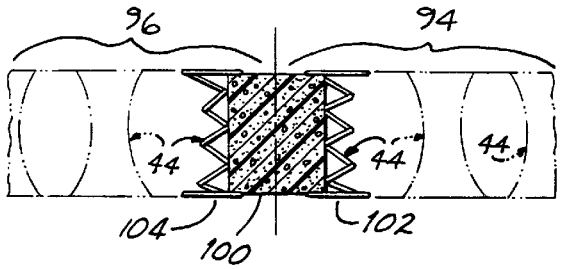
FIG. 7 is a side elevational view of the foam hinge of FIG. 6 with the two spring core sections located in a common horizontal plane.
Figure 6:
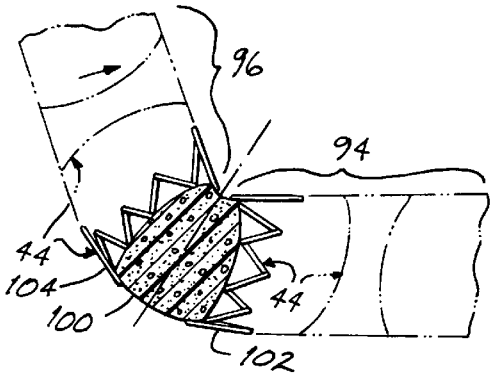
FIG. 6 is a view taken along the lines 6—6 of FIG. 5.

The first and second sections 94, 96 are connected to each other with a longitudinally extending foam hinge 100 seen in cross section in FIG. 6. The foam hinge 100 is identically configured to the foam hinge described hereinabove, the only difference being that this foam hinge 100 extends longitudinally rather than transversely. A column of coil springs 102 of the first section 94 of spring core is secured to the foam hinge 100 in the manner described hereinabove and likewise, a column of coil springs 104 of the second section 96 of spring core is similarly secured to the foam hinge 100 such that the articulated mattress 90 may move from the position of FIG. 6 in which the first and second sections 94, 96 of spring core are angled with respect to one another to the position of FIG. 7 in which the first and second sections 94, 96 of spring core are coplanar with one another, i.e., the mattress is flat.

While I have described two embodiments of the present invention, those skilled in the art will appreciate changes and modifications which can be made to the present invention without departing from the scope of the present invention. Therefore, I intend to be limited only by the scope of the following claims.

I claim:

1. An articulated mattress comprising:

an articulated mattress spring core having a longitudinal dimension, a transverse dimension and a depth dimension, the longitudinal dimension being greater than the transverse dimension, said articulated spring core comprising a first spring core section comprising a plurality of coil springs arranged in transversely extending rows and longitudinally extending columns, a second spring core section comprising a plurality of coil springs arranged in transversely extending rows and longitudinally extending columns, a foam hinge hingedly connecting said spring core sections, said foam hinge comprising a block of resilient foam extending the depth of said articulated mattress spring core, at least one row of coil springs of each of said first and second spring core sections being secured to said foam hinge, a mattress pad; and an upholstered fabric covering encasing said articulated spring core and said mattress pad.

2. The articulated mattress of claim 1 wherein said foam hinge futher comprises at least one piece of fabric secured to said block of resilient foam, said at least one row of coil springs of each of said first and second spring core sections further being secured to said at least one piece of fabric.

3. The articulated mattress of claim 1 wherein said at least one row of coil springs of each of said first and second spring core sections is secured to said foam hinge with hog rings.

4. The articulated mattress of claim 1 wherein said foam hinge is transversely extending, said foam hinge extending the full transverse dimension of said mattress.

5. The articulated mattress of claim 1 wherein said block of resilient foam is polyurethane foam.

6. The articulated mattress of claim 1 wherein said block of resilient foam has a rectangular cross section.

7. The articulated mattress of claim 1 wherein said block of resilient foam is a parallelepiped.

8. The articulated mattress of claim 1 wherein said coil springs of said first and second spring core sections have end turns connected to each other with transversely extending helical lacing wires.

9. The articulated mattress of claim 1 wherein said coil springs of said spring core sections are connected to each other with longitudinally extending helical lacing wires.

10. An articulated mattress spring core having a longitudinal dimension defined by two end edges and a transverse dimension defined by two side edges, said articulated mattress spring core comprising:

a first spring core section and a second spring core section, each spring core section comprising a plurality of aligned coil springs, each coil spring having an upper end turn and a lower end turn, a transversely extending foam hinge comprising a block of resilient foam, said block of resilient foam being secured to upper and lower end turns of at least one transversely extending row of coil springs of said first and second spring core sections in order to connect said spring core sections.

11. The articulated mattress spring core of claim 10 wherein said foam hinge further comprises an upper piece of fabric and a lower piece of fabric, said upper and lower pieces of fabric being secured to said block of resilient foam.

12. The articulated mattress spring core of claim 11 wherein said end turns of said at least one transversely extending row of said first and second spring core sections are additionally secured to said upper and lower pieces of fabric of said foam hinge.

13. The articulated mattress spring core of claim 11 wherein said upper and lower pieces of fabric of said foam hinge are secured to said block of resilient foam with adhesive.

14. The articulated mattress spring core of claim 10 wherein the coil springs of said first and second spring core sections have coplanar upper end turns and coplanar lower end turns when the articulated mattress is laid flat, said upper end turns defining a top plane and said lower end turns defining a bottom plane.

15. The articulated mattress spring core of claim 14 wherein said block of resilient foam extends from said top plane to said bottom plane.

16. The articulated mattress spring core of claim 10 wherein said block of resilient foam is secured to said upper and lower end turns of said at least one transversely extending row of coil springs of said first and second spring core sections with hog rings.

17. An articulated mattress spring core having a top face and a bottom face, said articulated mattress spring core comprising:

a first spring core section and a second spring core section, each spring core section comprising a plurality of aligned coil springs, each coil spring having an upper end turn and a lower end turn, a foam hinge comprising a block of resilient foam and an upper and lower piece of fabric secured to said block of resilient foam, said foam hinge being located between said spring core sections, a plurality of fasteners located in said top and bottom faces, said fasteners securing said foam hinge to said end turns of said coil springs of said first and second spring core sections.

18. The articulated mattress spring core of claim 17 wherein said fasteners are hog rings.

19. The articulated mattress spring core of claim 17 wherein said pieces of fabric of said foam hinge overlay the end turns of a plurality of coil springs of each spring core section.

20. The articulated mattress spring core of claim 19 wherein said end turns of said plurality of coil springs of each spring core section are secured to said pieces of fabric of said foam hinge with hog rings.

21. The articulated mattress spring core of claim 17 wherein said upper and lower pieces of fabric of said foam hinge are secured to said block of resilient foam with adhesive.

22. A futon comprising:

a futon frame comprising a seat support and a back support, an articulated futon mattress comprising an articulated spring core and a mattress cover, said articulated spring core comprising a first spring core section and a second spring core section, said spring core sections being secured to each other with a foam hinge, said foam hinge comprising a block of resilient foam, said foam hinge being secured to said spring core sections with hog rings which pass through said block of resilient foam in order to connect said spring core sections.

23. The futon of claim 22 wherein at least one of said spring core sections comprises a plurality of coil springs connected to each other with helical lacing wires.

24. An articulated mattress spring core comprising:

a first spring core section and a second spring core section, each spring core section having a longitudinal dimension, a transverse dimension and a depth dimension, the longitudinal dimension being greater than the transverse dimension, said spring core sections being aligned such that their longitudinal dimensions are parallel and a longitudinally extending foam hinge extending between said spring core sections, said foam hinge having a depth dimension at least as large as the depth dimension of one of said spring core sections and being secured to said spring core sections.

25. The articulated mattress spring core of claim 24 wherein at least one of said spring core sections comprises a plurality of coil springs connected to each other with helical lacing wires.

26. The articulated mattress spring core of claim 24 wherein said foam hinge comprises a block of resilient foam and at least one piece of fabric secured to said block of resilient foam.

27. The articulated mattress spring core of claim 24 wherein said spring core sections are secured to said foam hinge with hog rings.

28. The articulated mattress spring core of claim 27 wherein said hog rings pass through said block of resilient foam.

29. An articulated mattress spring core having a top surface and a bottom surface, said spring core comprising:

a plurality of substantially non-bendable spring core sections, each spring core section comprising a plurality of aligned coil springs, a pair of adjacent spring core sections being secured to a foam hinge, said foam hinge comprising a block of resilient foam, wherein said block of foam extends from said top surface to said bottom surface of said spring core.

30. The articulated mattress spring core of claim 29 wherein at least one coil spring of each of said adjacent coil spring sections is secured to said foam hinge.

* * * * *